United States Patent [19]

Ortwein

[11] Patent Number: 4,723,706

[45] Date of Patent: Feb. 9, 1988

[54] RAIL SUPPORT

[75] Inventor: Hermann Ortwein, Köln, Fed. Rep. of Germany

[73] Assignee: Clouth Gummiwerke Aktiengesellschaft, Cologne, Fed. Rep. of Germany

[21] Appl. No.: 822,618

[22] Filed: Jan. 24, 1986

[30] Foreign Application Priority Data

Feb. 1, 1985 [DE] Fed. Rep. of Germany ..... 3503428

[51] Int. Cl.[4] ..... E01B 9/40; E01B 9/68

[52] U.S. Cl. ..... 238/283; 238/287

[58] Field of Search ..... 238/265, 283, 287, 297, 238/298, 302, 307, 308, 309

[56] References Cited

U.S. PATENT DOCUMENTS

| | | | |
|---|---|---|---|
| 1,584,056 | 5/1926 | Wells | 238/283 X |
| 3,576,293 | 4/1971 | Landis et al. | 238/310 X |
| 4,327,865 | 5/1982 | Greene | 238/310 |
| 4,572,431 | 2/1986 | Arato | 238/283 |

FOREIGN PATENT DOCUMENTS

| | | | |
|---|---|---|---|
| 1137060 | 9/1962 | Fed. Rep. of Germany | 238/266 |
| 1204697 | 11/1965 | Fed. Rep. of Germany . | |
| 2347794 | 4/1975 | Fed. Rep. of Germany | 238/287 |
| 2828713 | 1/1980 | Fed. Rep. of Germany . | |
| 2832989 | 2/1980 | Fed. Rep. of Germany . | |
| 1228928 | 9/1960 | France | 238/283 |

*Primary Examiner*—Robert B. Reeves
*Assistant Examiner*—Russell D. Stormer
*Attorney, Agent, or Firm*—Michael J. Striker

[57] ABSTRACT

A rail support comprises a ribbed plate having smaller and greater sides and predetermined width and length, the width of the ribbed plate being measured in a direction transverse to the direction of elongation of rails to be supported while the length of the ribbed plate being measured in the direction of elongation of the rails, the width of the ribbed plate being greater than the length of the same, the ribbed plate being provided with openings for passage of connecting elements for connecting the ribbed plate to a foundation, a substantially flat rubber body arranged under the ribbed plate so as to support the latter and having smaller and greater sides and width and length, the length of the rubber body corresponding to the length of the ribbed plate while the width of the rubber body being greater than the width of the ribbed plate so that the rubber body at its small sides extend outwardly beyond the ribbed plate at the small sides of the latter, a shell-shaped frame enclosing the rubber body at its all sides and enclosing the ribbed plate at its greater sides and having a bottom, the rubber body and the bottom of the frame being provided with openings corresponding to the openings of the ribbed plate.

8 Claims, 3 Drawing Figures

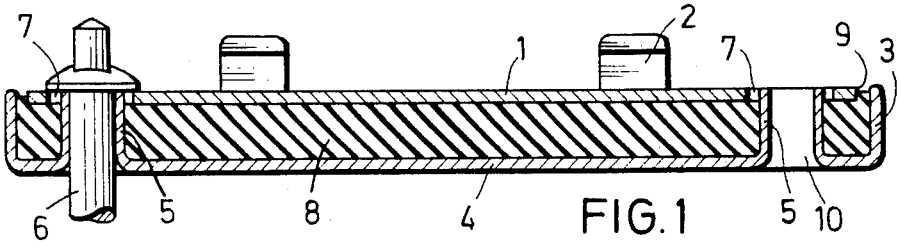
FIG. 1
FIG. 2
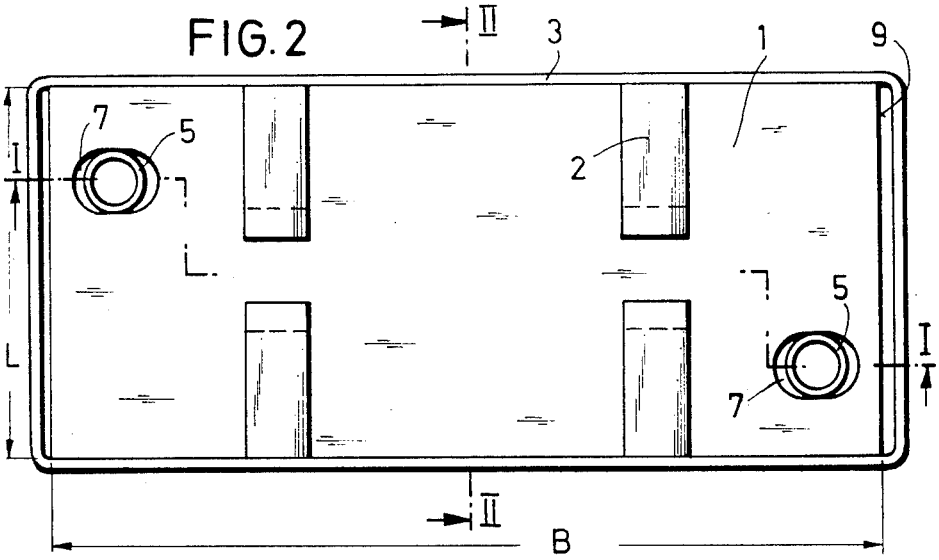
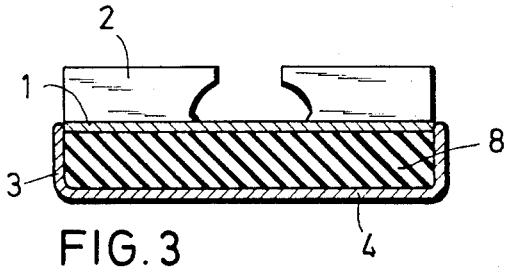
FIG. 3

RAIL SUPPORT

BACKGROUND OF THE INVENTION

The present invention relates to a rail support. More particularly, it relates to a rail support with a ribbed plate.

Rail supports of the above mentioned general type are known in the art. A known rail support has a ribbed plate with a width measured in a direction transverse to the rails and being greater than the length measured in the longitudinal direction of the rails. The ribbed plate is provided with openings for passage of connecting elements, such as bolts by means of which the ribbed plate is mounted on a foundation. Rail supports of the above mentioned general type are disclosed, for example, in the DE-AS No. 1,204,697 and in the DE-OS Nos. 2,828,713 and 2,832,989. The above described rail supports possess some disadvantages which can be eliminated.

SUMMARY OF THE INVENTION

Accordingly, it is an object of the present invention to provide a rail support with an elastically supported ribbed plate, which is relatively rigid under the action of vertical forces and also forces applied in the longitudinal direction of rails, but is soft and allows great deflections in a direction which is transverse to the longitudinal direction of rails, so that the rail head during loading transversely to the rails is not displaced too far from its normal position.

In keeping with these objects and with others which will become apparent hereinafter, one feature of the present invention resides, briefly stated, in a rail support in which the ribbed plate lies on a flat rubber body with a length corresponding to the length of the ribbed plate and a width which is greater than the width of the ribbed plate, and a shell-shaped rigid frame surrounds the rubber body at its all sides and surrounds the ribbed plate only at its greater or longitudinal sides, while the rubber body and a bottom of the frame are provided with openings which correspond to the openings in the ribbed plate and used for passage of connecting elements.

When the rail support is designed in accordance with the present invention, it has a higher position stability in a vertical direction and in the longitudinal direction of the rails of a rail track, and at the same time the rail track is supported relatively soft with respect to the forces acting transversely to the longitudinal direction of the rails. Since the flat rubber body is completely enclosed peripherally by the rigid frame, the spring rigidity of the rubber body in the vertical direction is relatively high. Since, furthermore, the ribbed plate abuts with its both longitudinal sides against the longitudinal walls of the frame, the rail support is also rigid in the longitudinal direction of the rails. The ribbed plate can thereby move inside the frame substantially only transversely to the longitudinal direction of the rails and against the increased resistance of the rubber body.

In accordance with another feature of the present invention, rigid sleeves formed as spacers are arranged in the openings of the rubber body. In the event of the mounting of the ribbed plate or the whole rail support on a foundation composed of for example of concrete, an excessively high compression of the rubber body is prevented by the sleeves so that the rubber body is tensioned to a desired exactly adjustable degree.

The sleeves are rigidly mounted on the bottom of the frame, for example, by welding. On the other hand, they can be formed by punching out from the bottom of the frame.

In accordance with a further embodiment of the present invention, the openings in the ribbed plate are formed elongated in a direction transverse to the longitudinal direction of the rails, and the sleeves engage in these elongate openings. In this construction, the sleeves which are rigidly mounted on the bottom of the frame do not prevent the movement of the ribbed plate transversely to the longitudinal direction of the rails.

The heads or the nuts of the mounting bolts abut against the above described sleeves.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a side view of a rail support in accordance with the present invention, in a section taken along the line I—I in FIG. 2;

FIG. 2 is a plan view of the rail support in accordance with the present invention; and FIG. 3 is a view showing a section taken along the line III—III in FIG. 2.

DESCRIPTION OF A PREFERRED EMBODIMENT

A rail support in accordance with the present invention has an elastically supported ribbed plate 1. Its width W measured in a direction transverse to the direction of elongation of the rails to be supported is greater than the length L measured in the direction of elongation of the rails.

The ribbed plate 1 lies on a flat rubber body 8. The length of the rubber body 8 corresponds to the length L of the ribbed plate 1, while the width of the rubber body 8 is greater than the width W of the ribbed plate 1. The rubber body 8 is flat and cubical. It is surrounded by a relatively rigid shell-shaped frame 3.

Since the width of the ribbed plate 1 is smaller than the width of the rubber body 8, several millimeters remain between the inner surfaces of the frame walls at the small sides of the frame 3, on the one hand, an outer surfaces of the plate 1 at its smaller sides 9. This gap can be equal, for example to 3–8 mm. For mounting the ribbed plate 1 of the rail support on a solid foundation, particularly of concrete, bolts 6 are provided. They extend through openings 7 provided in the ribbed plate 1 and through openings 10 provided in the rubber body 8 and in a bottom 4 of the frame 3.

For preventing excessive compression of the rubber body 8 during tightening of the mounting screw 6, relatively rigid sleeves 5 are provided in the recesses of the rubber body 8. The sleeves 5 abut against the bottom 4 of the frame 3. In the embodiment shown in the drawing, the sleeves 5 are formed one piece with the bottom 4 of the frame 3 and of the same material and can be produced by punching.

The openings 7 in the ribbed plate 1 for passage of the bolts 6 are elongated in a direction which is transverse to the longitudinal direction of the rails. During tightening of the pins, the head of the bolts 6 press the ribbed plate 1 against the flat rubber body 8 until the head of the bolts 6 abuts against the upper edge of the sleeve 5. A rail which is mounted on such ribbed plate 1 is completely rigidly supported in the longitudinal direction of the rails. In the vertical direction the rails are supported relatively rigidly, and in a direction transverse to the longitudinal direction of the rails they are supported softly to a limited degree without the danger of bringing the rail head too far from its normal position in the event of increased pushing forces.

As can be seen from FIG. 3 the rails are held by ribs which are identified with reference numeral 2 and provided on the upper surface of the plate 1.

It will be understood that each of the elements described above, or two or more together, may also find a useful application in other types of constructions differing from the types described above.

While the invention has been illustrated and described as embodied in a rail support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An elastic rail support, comprising a ribbed plate formed for supporting of rails thereon and provided with a plurality of ribs for holding the rails on said ribbed plate, said ribbed plate having smaller and greater sides and predetermined width and length, the width of said ribbed plate being measured in a direction transverse to the direction of elongation of rails to be supported while the length of said ribbed plate being measured in the direction of elongation of the rails, the width of said ribbed plate being greater than the length of the same, said ribbed plate being provided with openings for passage of connecting elements for connecting said ribbed plate to a foundation; means for elastically supporting said ribbed plate on the foundation and including a substantially flat rubber body arranged under said ribbed plate so that said ribbed plate lies freely on said rubber body and is not connected with the latter and having smaller and greater sides and width and length, the length of said rubber body corresponding to the length of said ribbed plate while the width of said rubber body being greater than the width of said ribbed plate so that said rubber body at its small sides extend outwardly beyond said ribbed plate at the small sides of the latter; and a shell-shaped frame which has a laterally closed wall enclosing said rubber body at its all sides and enclosing said ribbed plate without play only at its greater sides and therefore without play only in the direction of elongation of the rails so that the elastic rail support is elastic only in the direction transverse to the direction of elongation of the rails and is rigid in the direction of elongation of the rails, said frame having a bottom which supports said rubber body so that said rubber body lies freely on said bottom of said frame and is not connected to the latter, said rubber body and said bottom of said frame being provided with openings corresponding to said openings of said ribbed plate.

2. A rail support as defined in claim 1; and further comprising rigid sleeves arranged in said openings of said rubber body and formed as spaces for preventing excessive compression of said rubber body.

3. A rail support as defined in claim 1, wherein said openings of said ribbed plate being elongated in a direction transverse to the direction of elongation of the rails so that the rails are supported substantially yieldably in said transverse direction.

4. A rail support as defined in claim 2, wherein said sleeves extend in said openings of said ribbed plate.

5. A rail support as defined in claim 3, wherein said sleeves extend into said elongated openings of said ribbed plate.

6. A rail support as defined in claim 2, wherein said sleeves are fixedly mounted on said bottom of said frame.

7. A rail support as defined in claim 6, wherein said sleeves are formed of one piece with said bottom of said frame.

8. A rail support as defined in claim 7, wherein said sleeves are formed from said bottom of said frame by punching.

* * * * *